US006045284A

United States Patent [19]

Chiu

[11] Patent Number: 6,045,284

[45] Date of Patent: Apr. 4, 2000

[54] EXTENSIBLE CLEANER ROD

[75] Inventor: Jin-Yue Chiu, Tainan, Taiwan

[73] Assignee: Tery Star Industries Co., Ltd., Tainan, Taiwan

[21] Appl. No.: 09/115,609

[22] Filed: Jul. 15, 1998

[51] Int. Cl.[7] ..... A46B 11/06

[52] U.S. Cl. ..... 401/289; 401/282; 15/144.4; 285/302

[58] Field of Search ..... 401/16, 117, 99, 401/282, 289; 16/115; 15/144.4, 144.3, 144.1, 143.1; 138/119; 285/302

[56] References Cited

U.S. PATENT DOCUMENTS 4,154,545 5/1979 Pinto et al. ..... 15/144.4

4,652,024 3/1987 Krohn ..... 401/289

5,584,594 12/1996 Newville ..... 401/289

*Primary Examiner*—David J. Walczak

*Attorney, Agent, or Firm*—Rosenberg, Klein & Lee

[57] ABSTRACT

An extensible cleaner rod includes an outer tube and an inner tube telescoped in the outer tube, and then a water guide tube of a smaller diameter than that of the inner tube is provided in the outer tube. Then the volume of water flowing through the cleaner rod is always definite, no matter how large the outer tube and the inner tube may be. So the extensible cleaner rod may be used easily not adding a large weight to the whole cleaner rod even by enlarging the diameter of the outer tube and the inner tube for strengthen it.

3 Claims, 4 Drawing Sheets

EXTENSIBLE CLEANER ROD

BACKGROUND OF THE INVENTION

This invention relates to an extensible cleaner rod, particularly to one having a water guide tube for limiting the volume of water flowing through it so that even a cleaner rod of a large diameter and a long length may have a proper weight for convenience of handling for users.

A conventional extensible cleaner rod used for cleaning windows or transportation shown in FIG. 5 includes an outer tube 10, an inner tube 20, a first position sleeve 11, a second position sleeve 12, a connecting sleeve 13, a stop sleeve 21 and an end cap 22 as main components.

The first position sleeve 11 is shaped tubular, having an annular stop edge 111 formed in an inner wall of an intermediate portion, and male threads 112 formed on an outer surface of a right side portion.

The second position sleeve 12 is shaped conical, having female threads 121 formed in a left side portion to engage the male threads 112 of the first position sleeve 11, and a smaller inner diameter portion 122 behind the female threads 121 for a C-shaped locking ring to fit therein.

The connecting sleeve 13 has a right end opening 131, a chamber 132 formed in a left end portion, and female threads 133 formed between the chamber 132 and the right end opening 131.

The stop 21 is a short tube fixed in a rear end of the inner tube 20, having a conical flange with a vertical stop edge 211 to contact and be stopped by the vertical stop edge 111 of the first position sleeve 11 when the inner tube is telescoped in the outer tube 10.

The end cap 22 has a proximal cylindrical portion fitting around a front end of the inner tube 20, an intermediate conical portion 221 and a distal male threaded portion 222.

In assembling, as shown in FIG. 6, the rear end of the outer tube 10 is fitted firmly in the right end opening 131 of the connecting sleeve 13, and the rear end of the inner tube 20 is closed with the stop 21. Then the inner tube 20 is inserted and telescopes in the outer tube 10, and the first position sleeve 11 is fitted around the front end of the outer tube 10, with the stop edge 111 contacting the end surface of the outer tube 10. Then the second position sleeve 12 is fitted around the rear end of the inner tube 20, and the end cap 22 is fitted around the front end of the inner tube 20. Next, a brush (not shown) is screwed with the male threads portion 222 of the end cap 20, and a water hose ( not shown) is screwed with the chamber 132 of the connecting sleeve 13 for water to flow in the outer and the inner tube 10 and 20 and out of the end cap 22 with the brush. Tightness of the second position sleeve 12 against the male threads 112 of the first position sleeve 11 may be adjusted by rotating the second position sleeve 12 for loosening or tightening the locking ring 123 so that the inner tube 20 may be loosened or tightened in the outer tube 10 at any length telescoped in the outer tube 10 for a user to hold the cleaner rod.

As the inner tube 20 can be extended out of the outer tube 10 for any length for adjusting the whole length of the cleaner rod, the inner and the outer tube 20 and 10 may be not strong enough if the inner tube 20 extends out too long. Further, if the diameter of the inner and the outer tube 20 and 10 are increased, the water volume flowing through the outer and the inner tube 10 and 20 also increase, resulting in the weight of the water plus the inner and the outer tube 20 may be too large a burden for a user to hold for cleaning work.

SUMMARY OF THE INVENTION

This invention has a purpose of offering an extensible cleaner rod further including a water guide tube inside an outer tube to limit the volume of water flowing in the cleaner rod, and then even the outer and the inner tube are enlarged in diameter, the whole weight of the cleaner rod plus the water may not increase too much, with water weight is definite, not increased.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
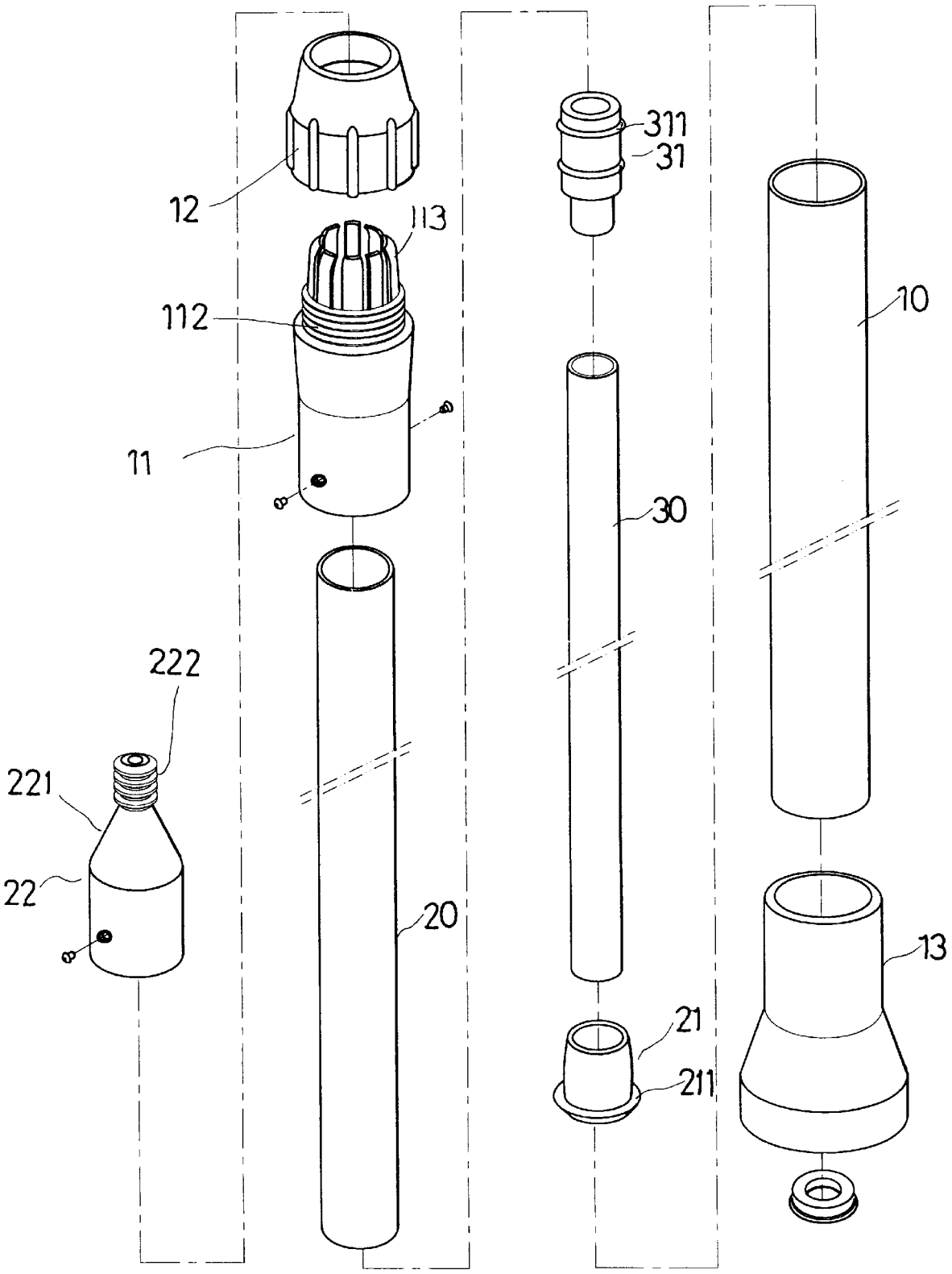
FIG. 1 is an exploded perspective view of an extensible cleaner rod of the present invention.

A preferred embodiment of an extensible cleaner rod of the present invention, as shown in FIG. 1, has a structure generally the same as the conventional one described above, except the difference described below.

A connecting sleeve 13 further has a concentrical recess 134 provided deeper in the bottom of the front end opening 131, and a water guide tube 30 of a smaller diameter than that of the inner tube 20 has a rear end fitted in the recess 134 and the front end fitted tightly in the rear end of the inner tube 20. And a stop sleeve 31 is fixed with the front end of the water guide tube 30 with some annular anti-leak gaskets 311 fixed around the stop sleeve 31 for preventing water from leaking out of the first and the second position sleeve 11 and 12.

The first position sleeve 11 has a plurality of lengthwise position nails 113 spaced apart and extending forward from the male threads section 112 so as to combine with the second position sleeve 12 by fitting in with some elasticity of the nails 113, functioning to pinch and hold tightly the inner tube 20 at any of many positions, without need of the locking ring 123 of the conventional one.

Figure 2:
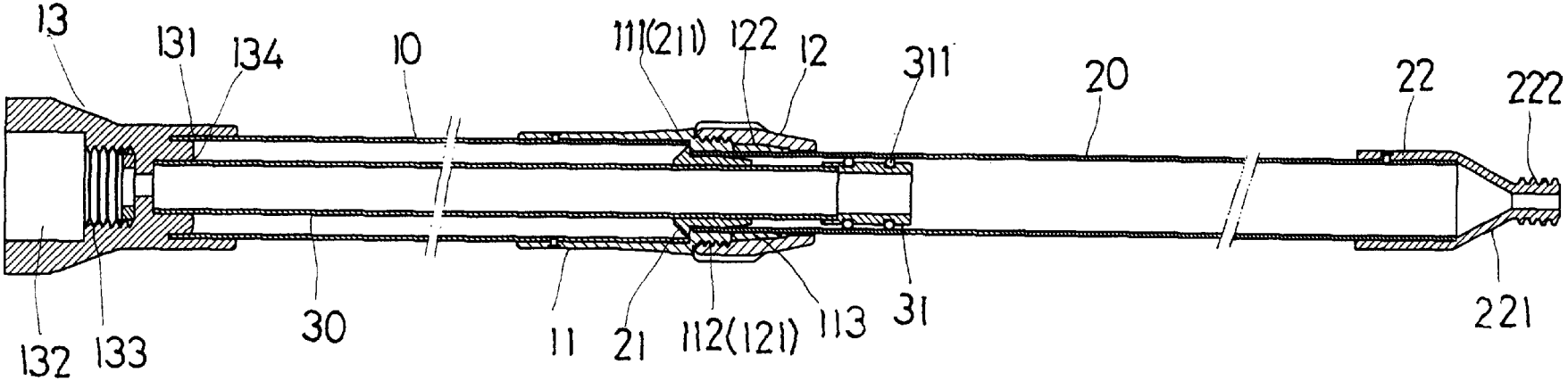
FIG. 2 is a cross-sectional view of the extensible cleaner rod of the present invention, showing an inner tube telescoped out of an outer tube for the longest distance.
Figure 3:
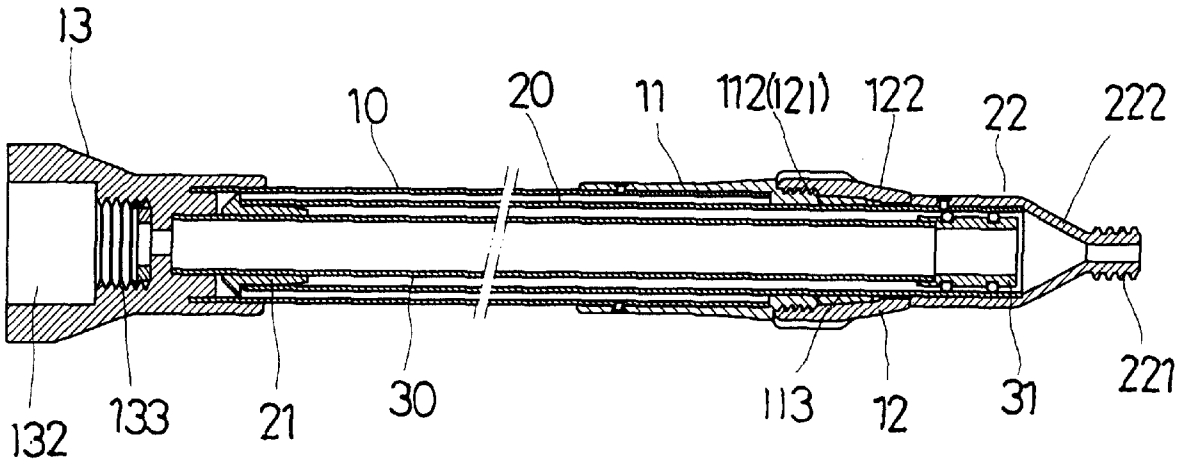
FIG. 3 is a cross-sectional view of the extensible cleaner rod of the present invention, showing the inner tube wholly shrunk in the outer tube.
Figure 4:
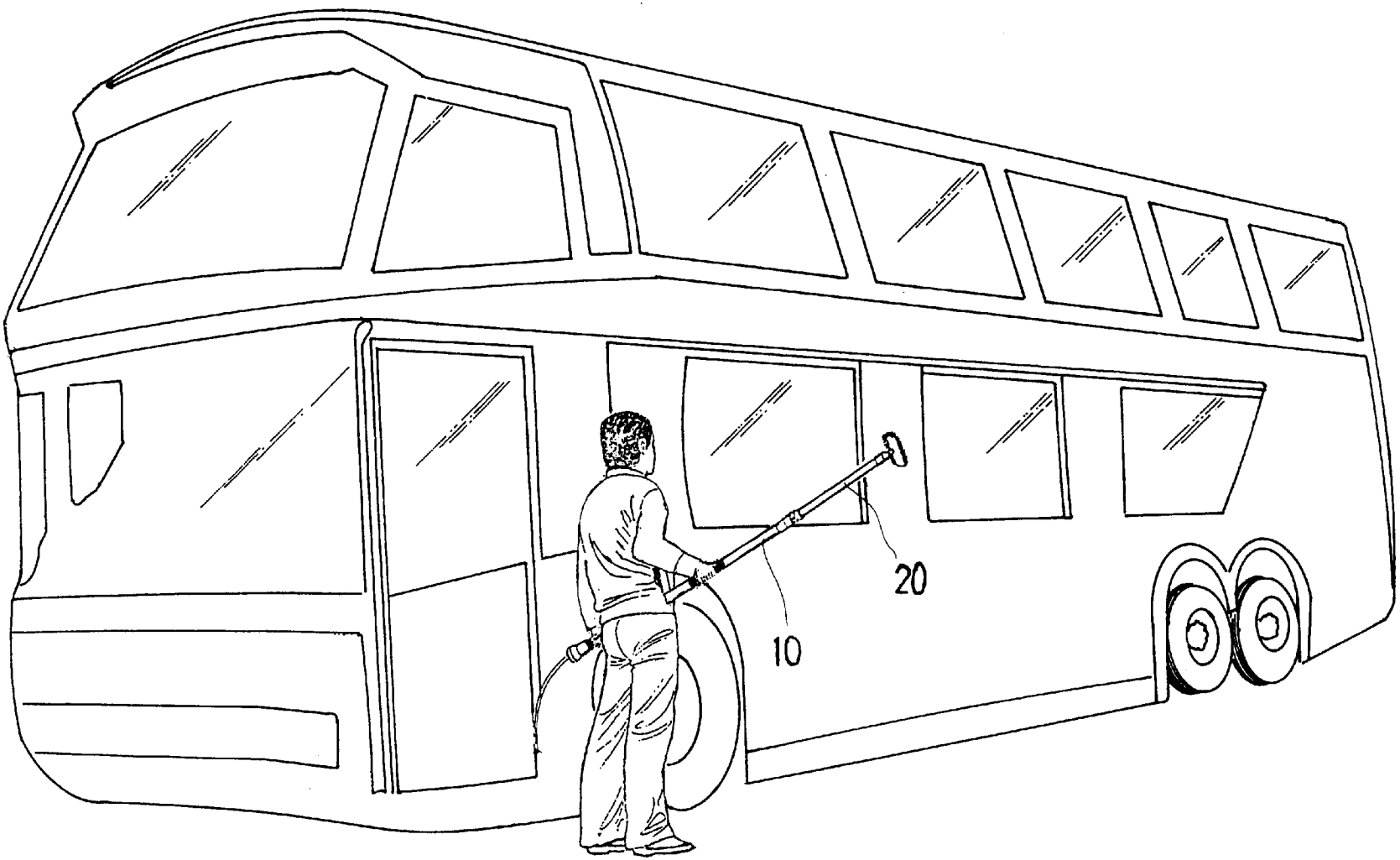
FIG. 4 is a perspective view of the cleaner rod of the present invention, showing it used in cleaning a bus.
Figure 5:
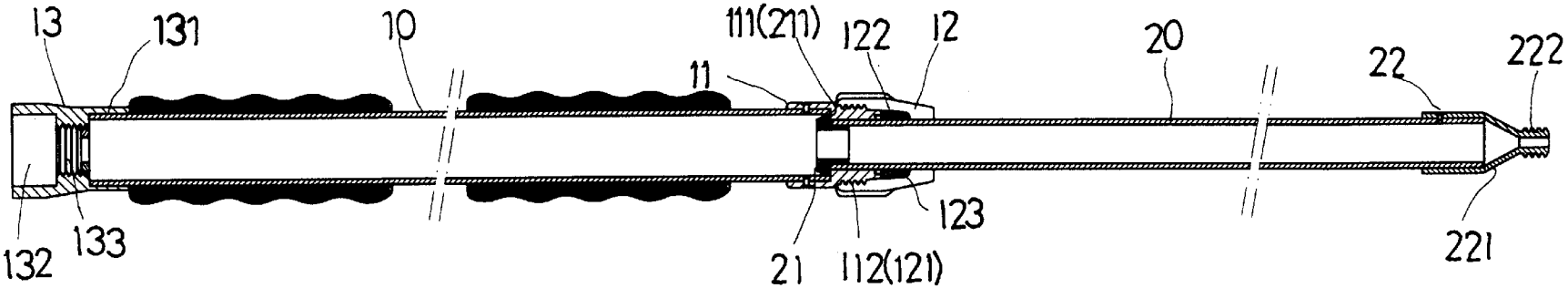
FIG.5 (PRIOR ART)
FIG. 5 is a cross-sectional view of a conventional cleaner rod, showing an inner tube extending out of an outer tube for the longest distance; and, FIG. 6 is a cross-sectional view of the conventional cleaner rod, showing the inner tube wholly shrunk in the outer tube.
Figure 6:
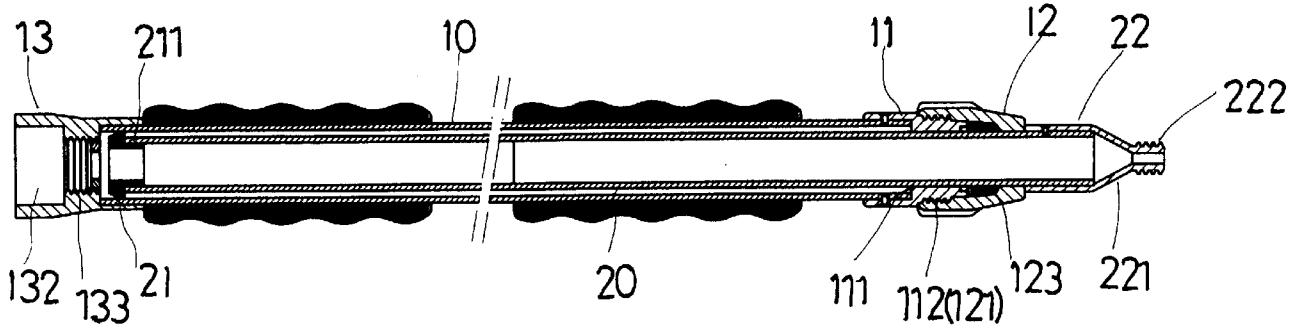
FIG.6 (PRIOR ART)

In using the cleaner rod of the invention, a user rotates the second position sleeve 12, and pulls the inner tube 20 out of the outer tube 10 to a needed length, and the longest length of the inner tube 20 is the point where the stop edge 211 is stopped by the stop edge 111 of the first position sleeve 11. Water flows from the water hose through the connecting sleeve 13 and into the water guide tube 30, through the stop 21, into the inner tube 20 and then out of the end cap 22 to the brush (not shown), as shown in FIG. 2, 3 and 4.

Provision of the water guide tube 30 can keep the volume of water definite flowing through the cleaner rod, no matter how large are the diameter of the outer and the inner tube 10 and 20. So in order to strengthen the cleaner rod, the outer and the inner tube 10 and 20 may have a larger diameter, not increasing the weight of water flowing through, and handy for use.

What is claimed is:

1. An extensible cleaner rod comprising:

an outer tube;

an inner tube provided to telescope in said outer tube;

an annular stop fixed in an inner end of said inner tube and sliding with said inner tube in said outer tube, having an annular vertical stop edge;

a first position sleeve fitted firmly around a front end portion of said outer tube, having an annular vertical stop edge contacting the annular vertical stop edge of said annular stop when moved with said inner tube telescoping out of said outer tube to the longest distance, and male threads formed on a front portion fitting around a rear end of said inner tube, and a plurality of position nails extending out from said male threads and spaced apart to fit around an outer surface of the inner end of said inner tube;

a second position sleeve fitting around said front portion of said first position sleeve and around the inner end portion of said inner tube, having female threads engaging said male threads of said first position sleeve so as to rotate said second sleeve against said first position sleeve in loosening or tightening said inner tube to lock said inner tube at any of many adjusted positions telescoped out of said outer tube;

a connecting sleeve having a front opening for a rear end of said outer tube to fit firmly therein, a rear chamber with a female threaded hole for a water hose to engage with;

an end cap having a proximal cylindrical portion to fit around an outer end of said inner tube, an intermediate conical portion, and a distal male threads portion for screwing with a brush for cleaning; and, characterized by a water guide tube having a smaller diameter than that of said inner tube, its rear end fitted firmly in the front opening of said connecting sleeve, and its front end inserting in said inner tube.

2. The extensible cleaner rod as claimed in claim 1, wherein said water guide tube has a stop sleeve fitted firmly around a front end thereof to face toward said annular stop of said inner tube.

3. The extensible cleaner rod as claimed in claim 1, wherein said connecting sleeve has a deeper concentrical hole in said front opening for a rear end of said water guide tube to fit firmly therein.

* * * * *